US007320541B2

(12) United States Patent
Wagner et al.

(10) Patent No.: US 7,320,541 B2
(45) Date of Patent: Jan. 22, 2008

(54) MIXER ELEMENT FOR A MIXER FOR MULTI-COMPONENT PASTES, AND MIXER USING THE SAME

(75) Inventors: Ingo W. Wagner, Woerthsee (DE); Helmut Pauser, Diessen (DE)

(73) Assignee: 3M ESPE AG, Seefeld (DE)

( * ) Notice: Subject to any disclaimer, the term of this patent is extended or adjusted under 35 U.S.C. 154(b) by 39 days.

(21) Appl. No.: 10/916,068

(22) Filed: Aug. 11, 2004

(65) Prior Publication Data

US 2005/0226095 A1 Oct. 13, 2005

(30) Foreign Application Priority Data

Aug. 14, 2003 (EP) ..... 03017685

(51) Int. Cl.
*B01F 7/00* (2006.01)

(52) U.S. Cl. ..... 366/172.1; 366/172.2; 366/329.2; 222/145.6

(58) Field of Classification Search .. 366/172.1–172.2, 366/176.1, 181.5, 325.1, 325.2, 326.1, 329.1, 366/329.2, 312; 222/145.5, 145.6
See application file for complete search history.

(56) References Cited

U.S. PATENT DOCUMENTS 2,816,518 A 12/1957 Daggett
3,051,455 A * 8/1962 Magester ..... 366/172.1
3,226,093 A * 12/1965 Gugel et al. ..... 366/290
3,302,832 A * 2/1967 Anderson et al. ..... 222/94
3,390,814 A * 7/1968 Creighton, Jr. et al. ..... 222/137
3,570,716 A 3/1971 Kirsanoff et al. ..... 222/67
3,570,719 A * 3/1971 Schiff ..... 222/137
3,587,982 A * 6/1971 Campbell ..... 241/62
3,606,094 A * 9/1971 Mills et al. ..... 222/145.6
3,767,085 A * 10/1973 Cannon et al. ..... 222/82
3,774,809 A 11/1973 Bratton ..... 222/137
4,107,793 A * 8/1978 Wallace ..... 366/312
4,408,890 A 10/1983 Beckmann ..... 366/155
4,432,469 A * 2/1984 Eble et al. ..... 222/134
4,469,153 A * 9/1984 Morrisette ..... 141/364
4,471,888 A * 9/1984 Herb et al. ..... 222/137

(Continued)

FOREIGN PATENT DOCUMENTS

DE 30 31 939 4/1982

(Continued)

OTHER PUBLICATIONS

Brochure entitled "1998/99—Innovationen & Mehr" from DMG Hamburg (14 pgs.).

(Continued)

*Primary Examiner*—Charles E. Cooley
(74) *Attorney, Agent, or Firm*—Peter L. Olson

(57) ABSTRACT

The present invention relates to a mixer element for a mixer for producing a paste by mixing components, the mixer comprising a mixing chamber. The mixer element comprises a body portion comprising a longitudinal axis extending from a rear end to a front end of the body portion, mixing vanes or blades provided at the body portion, and closure elements for closing the inlet openings to the mixing chamber. The closure elements are arranged at the rear end of the body portion adjacent to the inlet openings, and provide a paste-tight closure.

15 Claims, 2 Drawing Sheets

U.S. PATENT DOCUMENTS

| | | | | |
|---|---|---|---|---|
| 4,538,920 | A | 9/1985 | Drake | 366/177 |
| 4,566,610 | A | 1/1986 | Herb | 222/137 |
| 4,767,025 | A * | 8/1988 | Gebauer et al. | 222/135 |
| 4,767,026 | A | 8/1988 | Keller et al. | 222/137 |
| 4,771,919 | A | 9/1988 | Ernst | 222/134 |
| 4,871,090 | A | 10/1989 | Hoffmann | 222/81 |
| 4,934,827 | A * | 6/1990 | Taschke et al. | 366/162.3 |
| 4,951,843 | A * | 8/1990 | Paetow | 222/145.6 |
| 4,995,540 | A | 2/1991 | Colin et al. | 222/132 |
| 5,033,650 | A | 7/1991 | Colin et al. | 222/137 |
| 5,064,098 | A | 11/1991 | Hutter, III et al. | 222/137 |
| 5,080,262 | A | 1/1992 | Herold et al. | 222/135 |
| 5,186,363 | A | 2/1993 | Haynes | 222/145 |
| 5,237,000 | A | 8/1993 | Lausberg et al. | 525/64 |
| 5,249,709 | A | 10/1993 | Duckworth et al. | 222/137 |
| 5,249,862 | A * | 10/1993 | Herold et al. | 366/312 |
| 5,332,122 | A | 7/1994 | Herold et al. | 222/105 |
| 5,421,650 | A | 6/1995 | Meyer | 366/88 |
| 5,487,606 | A | 1/1996 | Keller | 366/339 |
| 5,498,078 | A | 3/1996 | Keller | 366/339 |
| 6,115,935 | A * | 9/2000 | Collins et al. | 366/129 |
| 6,129,244 | A | 10/2000 | Hörth | 222/94 |
| 6,135,631 | A * | 10/2000 | Keller | 366/339 |
| 6,161,730 | A * | 12/2000 | Heusser et al. | 222/137 |
| 6,186,363 | B1 | 2/2001 | Keller et al. | 222/145.6 |
| 6,244,740 | B1 * | 6/2001 | Wagner et al. | 366/181.5 |
| 6,311,871 | B1 * | 11/2001 | Binder | 222/145.6 |
| 6,321,945 | B1 | 11/2001 | Girouard et al. | 222/113 |
| 6,328,182 | B1 | 12/2001 | Brugner | 222/145.6 |
| 6,352,177 | B1 * | 3/2002 | Bublewitz et al. | 222/82 |
| 6,394,314 | B1 | 5/2002 | Sawhney et al. | 222/137 |
| 6,394,643 | B1 * | 5/2002 | Bublewitz et al. | 366/172.1 |
| 6,443,612 | B1 * | 9/2002 | Keller | 366/307 |
| 6,457,609 | B1 * | 10/2002 | Keller | 222/137 |
| 6,523,992 | B1 * | 2/2003 | Bublewitz et al. | 366/172.1 |
| 6,527,203 | B2 | 3/2003 | Hurray et al. | 239/413 |
| 6,530,685 | B1 * | 3/2003 | Muhlbauer et al. | 366/336 |
| 6,540,395 | B2 * | 4/2003 | Muhlbauer et al. | 366/307 |
| 6,620,125 | B1 | 9/2003 | Redl | |
| 6,769,574 | B1 | 8/2004 | Keller | 222/137 |
| 6,820,766 | B2 | 11/2004 | Keller et al. | 222/137 |
| 6,837,399 | B1 * | 1/2005 | Wagner et al. | 222/145.6 |
| 6,837,612 | B2 * | 1/2005 | Bublewitz et al. | 366/172.1 |
| 6,854,621 | B2 * | 2/2005 | Keller | 222/137 |
| 6,932,243 | B2 * | 8/2005 | Keller | 222/145.6 |
| 2001/0004082 | A1 | 6/2001 | Keller et al. | 222/137 |
| 2001/0005338 | A1 * | 6/2001 | Muhlbauer et al. | 366/307 |
| 2002/0175186 | A1 * | 11/2002 | Keller | 222/145.6 |
| 2003/0123323 | A1 | 7/2003 | Bablewitz et al. | 366/172.1 |
| 2003/0137898 | A1 * | 7/2003 | Wagner et al. | 366/172.1 |
| 2004/0016773 | A1 | 1/2004 | Wagner | 222/137 |
| 2004/0085854 | A1 * | 5/2004 | Pauser et al. | 366/172.1 |
| 2004/0104249 | A1 | 6/2004 | Horth et al. | 222/145.6 |
| 2004/0257909 | A1 * | 12/2004 | Pieroni | 366/172.1 |
| 2004/0262332 | A1 | 12/2004 | Pauser et al. | 222/145.6 |
| 2005/0035153 | A1 * | 2/2005 | Brown | 222/145.6 |
| 2005/0205606 | A1 * | 9/2005 | Nehren et al. | 222/145.5 |
| 2005/0230422 | A1 * | 10/2005 | Muller et al. | 222/145.6 |
| 2005/0232073 | A1 * | 10/2005 | Wagner et al. | 366/172.1 |
| 2007/0175921 | A1 | 8/2007 | Keller | |

FOREIGN PATENT DOCUMENTS

| | | | |
|---|---|---|---|
| DE | 3233366 | A1 * | 9/1983 |
| DE | 3237353 | A1 * | 4/1984 |
| DE | 3303667 | A1 * | 8/1984 |
| DE | 36 06 001 | | 8/1987 |
| DE | 89 00 409.4 | | 4/1989 |
| DE | 3838593 | C1 * | 5/1990 |
| DE | 39 32 359 | | 4/1991 |
| DE | 40 26 685 | | 2/1992 |
| DE | 42 12 863 | | 10/1992 |
| DE | 42 02 591 | | 8/1993 |
| DE | 4235736 | C1 * | 3/1994 |
| DE | 93 14 012.6 | | 4/1994 |
| DE | 43 09 798 | | 9/1994 |
| DE | 94 12 703.4 | | 10/1994 |
| DE | 94 11 665.2 | | 12/1994 |
| DE | 94 17 665.5 | | 1/1995 |
| DE | 297 05 741 | | 9/1998 |
| DE | 10015133 | C1 * | 9/2001 |
| DE | 100 43 489 | A1 | 3/2002 |
| DE | 203 02 987 | | 5/2003 |
| DE | 102004008748 | A1 * | 9/2004 |
| EP | 0 087 029 | A1 | 8/1983 |
| EP | 0 232 733 | | 8/1987 |
| EP | 0 302 819 | | 2/1989 |
| EP | 328936 | A1 * | 2/1989 |
| EP | 0 319 135 | | 6/1989 |
| EP | 0 492 412 | | 12/1991 |
| EP | 0 472 448 | | 2/1992 |
| EP | 0 541 972 | | 5/1993 |
| EP | 0 584 428 | | 3/1994 |
| EP | 0 664 153 | | 7/1995 |
| EP | 1 029 585 | A1 | 2/2000 |
| EP | 1 029 585 | | 8/2000 |
| EP | 1 149 627 | | 3/2001 |
| EP | 1 110 559 | | 6/2001 |
| EP | 1 149 627 | A2 | 10/2001 |
| EP | 1149627 | A2 * | 10/2001 |
| JP | 6-226178 | * | 8/1994 |
| JP | 8-187727 | * | 7/1996 |
| WO | 98/43727 | * | 10/1998 |
| WO | WO 00/21652 | | 4/2000 |
| WO | WO 2003/064056 | | 8/2003 |
| WO | WO 2006/032467 | | 3/2006 |

OTHER PUBLICATIONS

Brochure entitled "Mixer (light-blue)—Mischer (hellblau)" from MIXPAC Systems AG (2 pgs.) dated Oct. 24, 1997.

* cited by examiner

MIXER ELEMENT FOR A MIXER FOR MULTI-COMPONENT PASTES, AND MIXER USING THE SAME

This application claims priority from European Patent No. 03017685.3, filed Aug. 14, 2003.

BACKGROUND OF THE INVENTION

The present invention relates to a mixer element for a mixer for multi-component pastes, and a mixer using the same.

Pasty multi-component masses, such as dental impression masses, are produced by means of mixing devices in which the individual components of the mass are simultaneously supplied from separate cartridge cylinders to a mixer which dispenses the mixed paste from a front end. The mixer may be a static mixer or a dynamic mixer (having a rotary mixer element). The paste exiting from the front end of the mixer may be supplied directly onto an impression spoon.

Examples of dynamic mixers are found in, e.g., WO 00/21652, EP-A-1 149 627, U.S. Pat. No. 5,249,862 or DE-U-297 05 741. These known dynamic mixers, have as their rear end (inlet side) a central hexagonal opening for coupling to a drive shaft for rotating the inner body of the mixer, and further two additional inlet connectors for feeding the components which are to be mixed.

Depending on the viscosity and mixing ratio, the fact that the pressure builds up differently in the individual cartridge cylinders at the start of the device may cause the components to reach the mixer at different times. In such a case, the first length of paste exiting from the mixer has a mixing ratio which differs from a desired value and may therefore cure less perfectly or more slowly, or have other undesired properties.

U.S. Pat. No. 6,244,740 suggests a mixer for producing multi-component pastes. This dynamic mixer contains a deviating channel provided between the inlet opening for the component of the larger volume proportion and the mixing chamber, in order to delay the feed of this component with respect to the other component. The presence of such a deviating channel causes all components to enter the mixing chambers simultaneously, thereby obtaining a paste which has the desired mixing ratio from the start.

SUMMARY OF THE INVENTION

The present invention may provide a mixer element for a mixer for multi-component pastes, which permits the production of a pasty mixture that has a desired mixing ratio from the start, without generating waste volume of the mixed components.

In one aspect, the invention provides a mixer element for a mixer for producing a paste by mixing components, said mixer comprising a mixing chamber, said mixer element comprising a body portion comprising a longitudinal axis extending from a rear end to a front end of said body portion, mixing means provided at said body portion, and closure elements for closing inlet openings to said mixing chamber, said closure elements being arranged at said rear end of said body portion adjacent to said inlet openings.

Preferably, the closure elements extend axially from the body portion. It is furthermore preferred that the closure elements comprise a cross-section being larger than the cross-section of the inlet openings. More preferably, the closure elements are provided in the form of paddles, more preferably mixing paddles. The closure elements provide a paste-tight closing of the inlet openings in order to prevent undesired entry of paste into the mixing chamber.

In cases where two components are to be mixed by the mixer element, two closure elements, for example mixing paddles, are provided that are preferably arranged opposite to each other.

Preferably, the body portion is rotatable about its longitudinal axis. It is also preferred that the body portion comprises an opening, more preferably a hexagonal opening, at its rear end for engagement to a complementarily formed end of a drive shaft.

The mixing means provided at the body portion are preferably formed by mixing vanes or mixing blades, respectively.

The mixer element preferably further comprises one or more wiper arms being integrally formed at the rear end of the body portion for cutting up the component strands as they are supplied through the inlet openings.

In order to avoid that the mixer element turns around during packaging, transportation or handling, the mixer element preferably comprises a locking element, more preferably with a predetermined breaking point, being located at said body portion for preventing undesired movement or rotation of said mixer element.

In a second aspect, the invention provides a mixer for producing a paste by mixing components. The mixer comprises a housing having a longitudinal axis, a rear end provided with separate inlet openings for each of said components, and a front end provided with a discharge opening, a mixing chamber formed in said housing, and a mixer element according to the first aspect of the present invention provided in said mixing chamber, said mixer element being supported in the housing for rotation about said longitudinal axis.

Preferably, the housing comprises a terminating plate closing the housing at its rear end. Preferably, the terminating plate comprises inlet pipes by which the mixer may be coupled to the front end of a cartridge placed in a dispensing apparatus. Said inlet pipes form inlet openings to the mixing chamber. Preferably, the inlet pipes or inlet openings, respectively, have different sizes in order to provide mixing ratios different from 1:1.

More preferably, the terminating plate comprises an engagement element corresponding to said locking element of said mixer element. Most preferably, this engagement element prevents movement of the mixer element until a predetermined breaking point is reached, and the locking element is broken off of the mixer element.

DETAILED DESCRIPTION OF A PREFERRED EMBODIMENT

Figure 4:
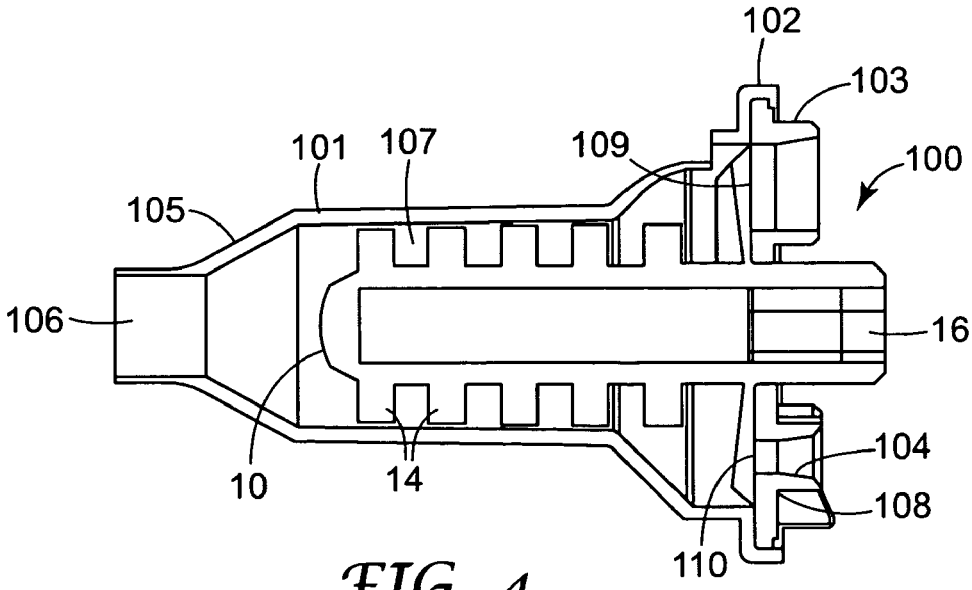
FIG. 4 shows an axial section taken at the plane 4 shown in FIG. 3 through a mixer according to the present invention.

The mixer 100 shown in FIG. 4 includes a housing 101 which has a mixing chamber 107 which is cylindrical throughout its principal part. The housing 101 has a longitudinal axis, a rear end 102 and a front end 105. At the rear end, the housing 101 is formed by a terminating plate 108 forming the rear wall of the housing 101. Furthermore, the mixer 100 shown in FIG. 4 comprises a mixer element 10 supported by the housing 101, in particular by the terminating plate 108. A hexagonal opening 16 is provided at the rear end 12 of the mixer element 10 for coupling to a drive shaft (not shown). The mixer element 10 is supported within the housing 101 for rotation about the longitudinal axis of the mixer element 10.

The terminating plate 108 has two rearward extending inlet pipes 103, 104, by which the mixer 100 may be coupled to the front end of a cartridge placed in a dispensing apparatus (not shown). In the embodiment illustrated, the mixer 100 is assumed to be adapted for producing a dental impression mass which is mixed, for example, from a pasty base substance and a catalyst substance at a specific ratio. To this end, the inlet pipe 103 and the inlet pipe 104 for the base substance and for the catalyst, respectively, have a cross-section area that provides the desired mixing ratio.

The two rearwardly projecting inlet pipes 103, 104 are integrally formed with the terminating plate 108 at positions off-set from the center bore. Preferably, the inlet pipes are positioned opposite to each other with regard to the center axis. The inlet pipes are adapted for being directly inserted into outlet openings of cartridges which contain the components to be mixed. Preferably, the outer surfaces of the pipe sockets are conically formed with a rearward tapering (as shown in FIG. 3) to provide a sufficient seal in the inlet pipes and the outlet openings of the cartridges.

Figure 3:
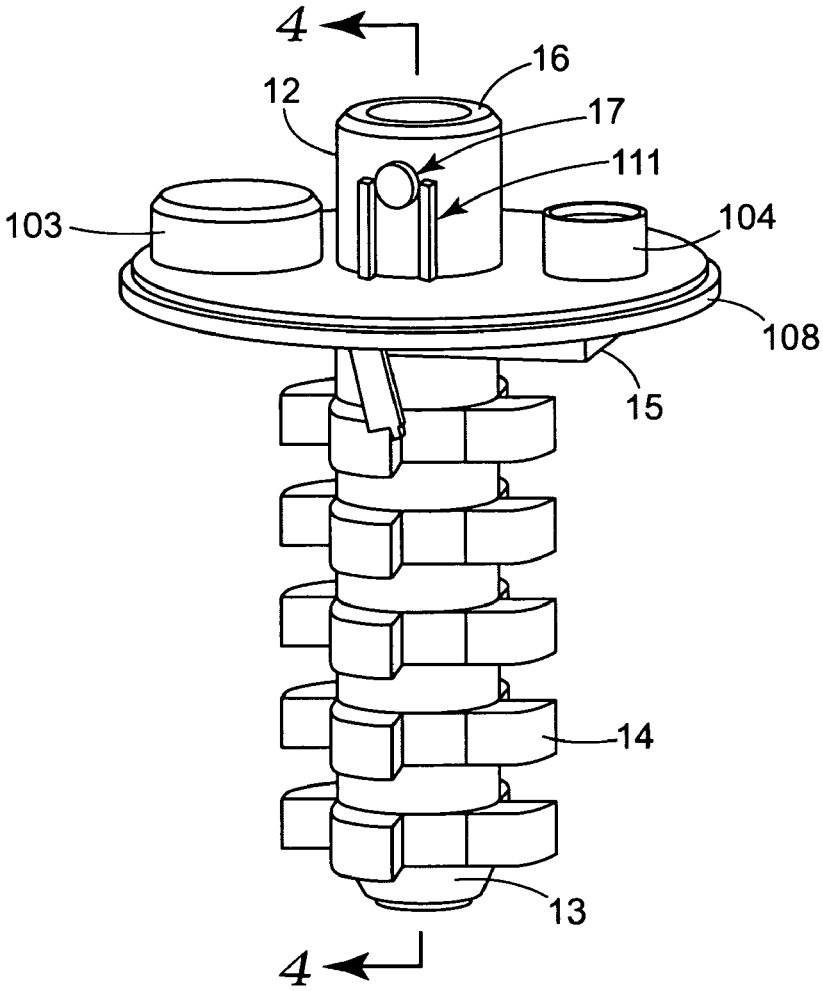
FIG. 3 is a perspective view of the mixer element according to the present invention with the terminating plate of the mixer according to the present invention.

In FIG. 3, the inlet pipes are shown with different internal cross-sections to illustrate a case in which two components are to be mixed at a ratio different from 1:1.

At the front end 105 of the mixer 100, a discharge opening 106 is provided for dispensing the mixed paste.

At the side of the terminating plate 108 facing the mixing chamber 107, the inlet pipes 103, 104 have inlet openings 109, 110.

In a preferred embodiment, the mixer identified by numeral 100 consists of three molded synthetic resin parts, namely the housing 101, the terminating plate 108 and the mixer element 10.

The terminating plate 108 is further provided with a central bore in which the hollow core or body portion, respectively, of the mixer element 10 is rotatably supported. As shown in FIG. 3, the end of the core of the mixer element 10 extends through the terminating plate 108 and has said hexagonal recess for engagement by the complementarily formed end of a drive shaft.

Figure 1:
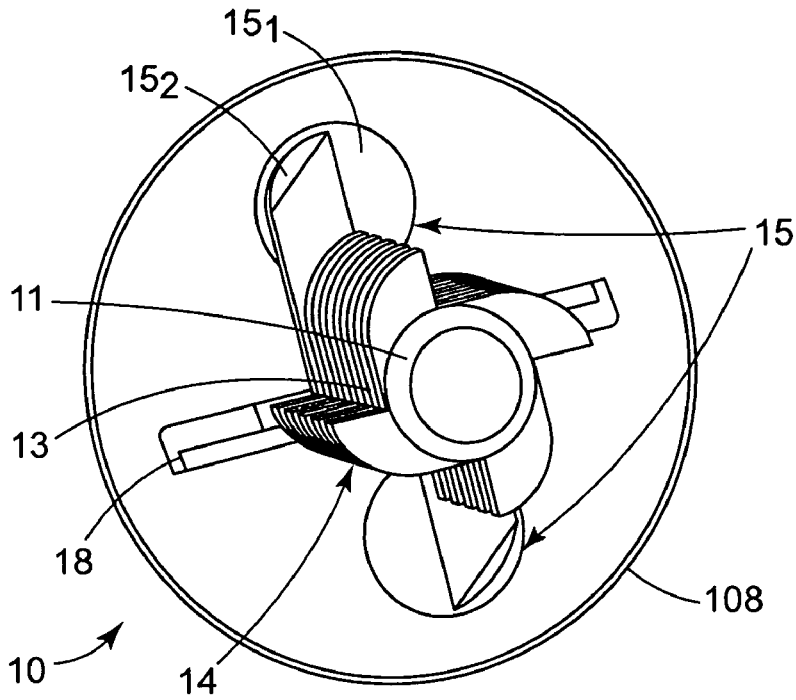
FIG. 1 is a perspective view of the mixer element according to the present invention, from below, the closure elements closing the inlet openings.
Figure 2:
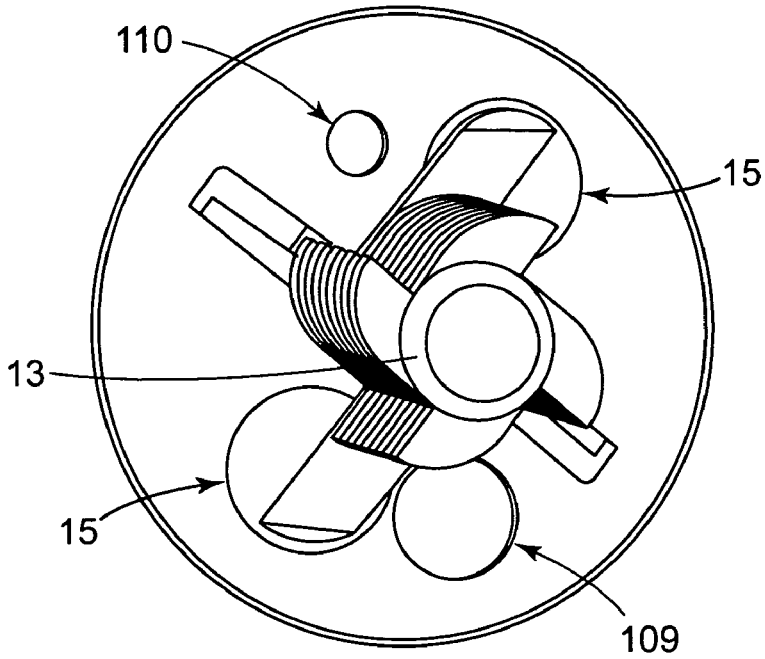
FIG. 2 is a perspective view of the mixer element of the present invention, from below, the inlet openings being open.

The mixer element 10 according to the present invention is shown in FIGS. 1 to 3. The mixer element 10 comprises a body portion 11 extending along the longitudinal axis of the mixer element 10. The body portion 11 comprises a rear end 12 and a front end 13 (see FIG. 3). In the embodiment shown in FIG. 3, a plurality of mixing vanes 14 are located along the body portion 11 as known in the art. Preferably, the mixer vanes are integrally formed on the outer surface of the core of body portion 11 of the mixer element 10. As shown in FIG. 4, the mixing vanes 14 are provided within the cylindrical portion of the mixing chamber 107 and end short of the internal chamber wall.

At its rear end, the mixer element 10 comprises closure elements. In the embodiment shown in FIGS. 1 and 2, two closure elements in the form of mixing paddles 15 are provided. In FIGS. 1 to 3, in addition to the mixer element 10 according to the present invention, the terminating plate 108 is shown in order to facilitate explanation of the location of the closure elements (mixing paddles 15) in relation to the housing of the mixer 100. As explained above, the terminating plate 108 comprises inlet openings 109, 110, and the closure elements 15 are arranged adjacent to said inlet openings 109, 110 for closing said inlet openings 109, 110. FIG. 1 shows the mixer element 10 in a position in which the inlet openings 109, 110 are tightly closed by the mixing paddles 15. FIG. 2 shows the mixer element 10 in a different rotational position with the inlet openings 109, 110 of the terminating plate 108 being uncovered or open, respectively.

In the embodiment shown in FIGS. 1 and 2, the mixing paddles comprise a circular disc-shaped portion $\mathbf{15}_1$ that effectively and tightly closes the inlet openings 109, 110 once the closure elements 15 cover the inlet openings 109, 110, and a paddle-shaped portion $\mathbf{15}_2$. Preferably, the cross-section of the disc-shaped portion $\mathbf{15}_1$ is larger than the cross-section of the inlet openings 109, 110 in order to provide an efficient closure.

The paddle-shaped portion $\mathbf{15}_2$ connects the disc-shaped portion $\mathbf{15}_1$ to the body portion 11. In the preferred embodiment shown in the Figures, the paddle-shaped portion $\mathbf{15}_2$ has a thickness along the longitudinal direction of the mixing element, i.e., perpendicular to the terminating plate 108, that varies along the width of the portion $\mathbf{15}_2$. For example, the thickness of the upper paddle-shaped portion $\mathbf{15}_2$ shown in FIG. 1 is less at the right-hand side of the portion $\mathbf{15}_2$ and increases towards the left-hand side of portion $\mathbf{15}_2$.

Furthermore, as shown in FIGS. 1, 2 and 4, the outer edges of portions $\mathbf{15}_2$ (i.e., the edge that is denoted by reference numeral $\mathbf{15}_2$ in FIG. 1) is angled with respect to the axial edges. This facilitates rotation of the paddles 15 since resistance against the paste in the mixing chamber is thus reduced.

During assembly procedure, the mixing paddles 15 are arranged in line with the inlet openings 109, 110, so that the mixer 10 has closed inlets after connecting the mixer 10 with the cartridge front end of the bags containing the components to be mixed. Once the dispensing apparatus containing the cartridges gets a trigger or start signal, the driving application plungers generate paste pressure due to the closed inlet openings 109, 110. When the increasing pressure meets a defined or predetermined pressure level, the drive shaft connected to the mixer element 10 starts rotating. Thus, the mixer element moves from the position shown in FIG. 1 to the position shown in FIG. 2, and paste is able to flow into the mixing chamber directly without any time delay.

According to a preferred embodiment of the present invention, the increasing pressure can be used to initiate a signal to the dispensing apparatus to change from the fast plunger drive mode (to reach the end of the component bags) into the slow application drive mode.

The mixer element 10 shown in FIGS. 1 and 2 further comprises a plurality of wiper arms 18 (two wiper arms 18 are shown in the Figures) that are integrally formed at the rear end of the body portion 11 of the mixer element 10. Each wiper arm 18 is preferably formed with a cutting edge at the side with leads when the mixer element 10 rotates. Starting from the cutting edge, each wiper arm 18 forms a forwardly rising inclined surface which assists in moving of the components in the discharging direction.

The cutting edges of the wiper arms 18 engage the inner surface of terminating plate 108 and serve to cut up the component strands as they enter the mixer housing via the inlet pipes 103, 104. The fact that the strands are immediately wiped off and cut up is advantageous because it guarantees a clear severing of the component strands in virtually any position, when the mixer 10 is removed from the cartridges.

A further preferred feature of the mixer element 10 of the present invention is shown in FIG. 3. In order to ensure that the mixer element does not rotate during packaging, transportation, or handling (which is important to avoid that a wrong signal is given to the dispensing apparatus), a locking element 17, for example in the form of a nipple or small plate, is provided at the rear end of the body portion 11 of the mixer element 10. At a complementary position, the terminating plate 108 comprises an engagement element, for example to parallel locking ribs 111 that hold the locking element 17 in place. As shown in FIG. 3, the locking element 17 is provided at the circumferential surface of the body portion 11 in the form of a circular disc that engages two parallel ribs 111 which are spaced from each other. The distance between the ribs 111 corresponds to the diameter of the disc 17. Thus, the mixer element is blocked from rotation. However, the locking element 17 comprises a predetermined breaking point so that it breaks away when the drive shaft of the dispensing apparatus start rotating.

This locking element/engagement element arrangement is furthermore advantageous in the assembly procedure because it allows placing the mixer element 10 into the housing 101 of the mixer 100 at a predetermined position.

The present invention is also applicable to mixers for producing a paste from more than two components. In such a case, closure elements like mixing paddles 15 may be provided between two or more inlet pipes/inlet openings to ensure that all components reach the mixing chamber 107 substantially simultaneously.

The present invention is advantageous in various aspects. Firstly, there is no need for a deviation channel for one of the components in order to guarantee that all components enter the mixing chamber simultaneously. Secondly, increasing paste pressure can be used to provide drive information to the dispensing apparatus, for example to change the speed level of the plungers. Finally, the assembly of the entire mixer can be simplified in that the mixer element is placed into the mixing chamber at a defined position.

The invention claimed is:

1. A mixer comprising a mixer element and a housing having a mixing chamber that includes inlet openings and contains the mixer element, wherein said mixer element cooperates with the housing to provide a paste-tight closure of the inlet openings when in a first position, and to open the inlet openings when in a second position.

2. The mixer of claim 1, wherein said mixer element comprises closure elements that extend radially from a body portion.

3. The mixer of claim 2, wherein the closure elements are larger in cross-section than said inlet openings.

4. The mixer of claim 2, wherein the closure elements are provided in the form of mixing paddles.

5. The mixer of claim 4, wherein the paddles comprise a circular disc-shaped portion for closing the inlet openings and a paddle-shaped portion connecting the disc-shaped portion with the body portion.

6. The mixer of claim 2, further comprising mixing vanes or mixing blades provided at said body portion.

7. The mixer of claim 2, wherein the body portion is rotatable about its longitudinal axis and comprises a hexagonal opening at its rear end connectable to the drive shaft of a dispensing apparatus.

8. The mixer of claim 2, further comprising a locking element for blocking undesired movement of said mixer element.

9. The mixer of claim 8, wherein the locking element is located at the rear end of said body portion.

10. The mixer of claim 8, wherein the locking element has a predetermined breaking point.

11. The mixer of claim 1, wherein:

the housing, has a longitudinal axis, a rear end provided with separate inlet openings for each of said components, and a front end provided with a discharge opening;

the mixing chamber is formed in said housing and has an entry side facing said rear end of said housing; and the mixer element is supported in said housing for rotation about said longitudinal axis.

12. The mixer of claim 11, wherein the rear end of the housing is formed by a terminating plate, comprising separate inlet pipes adapted for connection with a dispensing cartridge containing said components.

13. The mixer of claim 12, wherein the terminating plate comprises at its side facing the mixing chamber said inlet openings.

14. The mixer of claim 12, said terminating plate further comprising an engagement clement corresponding to a locking element provided at said mixer element for blocking undesired movement of the mixer element.

15. The mixer of claim 11, wherein said openings are different in size.

* * * * *

UNITED STATES PATENT AND TRADEMARK OFFICE

CERTIFICATE OF CORRECTION

PATENT NO. : 7,320,541 B2
APPLICATION NO. : 10/916068
DATED : January 22, 2008
INVENTOR(S) : Ingo W. Wagner and Helmut Pauser It is certified that error appears in the above-identified patent and that said Letters Patent is hereby corrected as shown below:

Column 6
Line 46, delete “clement” and insert in place thereof --element--.

Signed and Sealed this

Eleventh Day of November, 2008

JON W. DUDAS
*Director of the United States Patent and Trademark Office*